US010262475B2

(12) United States Patent
Smith

(10) Patent No.: US 10,262,475 B2
(45) Date of Patent: Apr. 16, 2019

(54) VEHICLE SENSOR HEALTH MONITORING

(71) Applicant: Ford Global Technologies, LLC, Dearborn, MI (US)

(72) Inventor: Joshua Scott Smith, Allen Park, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 55 days.

(21) Appl. No.: 15/410,610

(22) Filed: Jan. 19, 2017

(65) Prior Publication Data

US 2018/0204398 A1 Jul. 19, 2018

(51) Int. Cl.
*G07C 5/00* (2006.01)
*G07C 5/08* (2006.01)

(52) U.S. Cl.
CPC ..... *G07C 5/0808* (2013.01); *G07C 5/008* (2013.01); *G07C 5/0816* (2013.01)

(58) Field of Classification Search
CPC ..... G07C 5/008; G07C 5/0808; G07C 5/0816
See application file for complete search history.

(56) References Cited

U.S. PATENT DOCUMENTS

| | | | | |
|---|---|---|---|---|
| 8,924,071 | B2 | 12/2014 | Stanek | |
| 8,970,834 | B2 | 3/2015 | Soininen | |
| 9,254,802 | B2 | 2/2016 | Brenneis | |
| 2010/0057290 | A1 | 3/2010 | Brillhart | |
| 2012/0010764 | A1* | 1/2012 | Hamada | G01C 21/32 701/2 |
| 2015/0066412 | A1 | 3/2015 | Nordbruch | |
| 2015/0070207 | A1 | 3/2015 | Millar | |
| 2015/0161830 | A1* | 6/2015 | Lenhardt | G01K 13/00 701/30.5 |
| 2015/0350750 | A1 | 12/2015 | Yun | |
| 2017/0272913 | A1* | 9/2017 | Yamashiro | H04W 4/027 |
| 2018/0109937 | A1* | 4/2018 | Lee | H04W 4/44 |
| 2018/0136008 | A1* | 5/2018 | Engel | G01C 25/00 |

FOREIGN PATENT DOCUMENTS

| | | | | |
|---|---|---|---|---|
| DE | 102006043317 | A1 * | 3/2008 | G01M 17/007 |
| WO | WO-200971345 | A1 | 6/2009 | |
| WO | WO 2016/17748 | | 11/2016 | |
| WO | WO 2017/003350 | | 1/2017 | |

* cited by examiner

*Primary Examiner* — Aaron L Troost
(74) *Attorney, Agent, or Firm* — David R. Stevens; Stevens Law Group

(57) ABSTRACT

Techniques and examples pertaining to vehicle sensor health monitoring are described. A processor of a road-side station may receive first data from a vehicle and receive second data from one or more sensors associated with the road-side station. The processor may compare the first data and the second data. In response to a result of the comparing indicating a difference between the first data and the second data, the processor may generate a report.

20 Claims, 4 Drawing Sheets

VEHICLE SENSOR HEALTH MONITORING

TECHNICAL FIELD

The present disclosure generally relates to autonomous vehicles and, more particularly, to vehicle sensor health monitoring.

BACKGROUND

In general, autonomous vehicles are vehicles that are capable of sensing the environment and navigating without human input. Autonomous vehicles can detect the surrounding using a variety of sensors, and data provided by the sensors can be used by a control system of the autonomous vehicle to navigate and maneuver the vehicle appropriately. For instance, autonomous vehicles depend on sensors for positioning and object detection. However, if any of the sensors malfunctions and one or more local redundant sensors do not recognize such problem, it is possible that the autonomous vehicle can operate sporadically and even tragically.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified.

DETAILED DESCRIPTION

In the following description, reference is made to the accompanying drawings that form a part thereof, and in which is shown by way of illustrating specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense.

Figure 1:
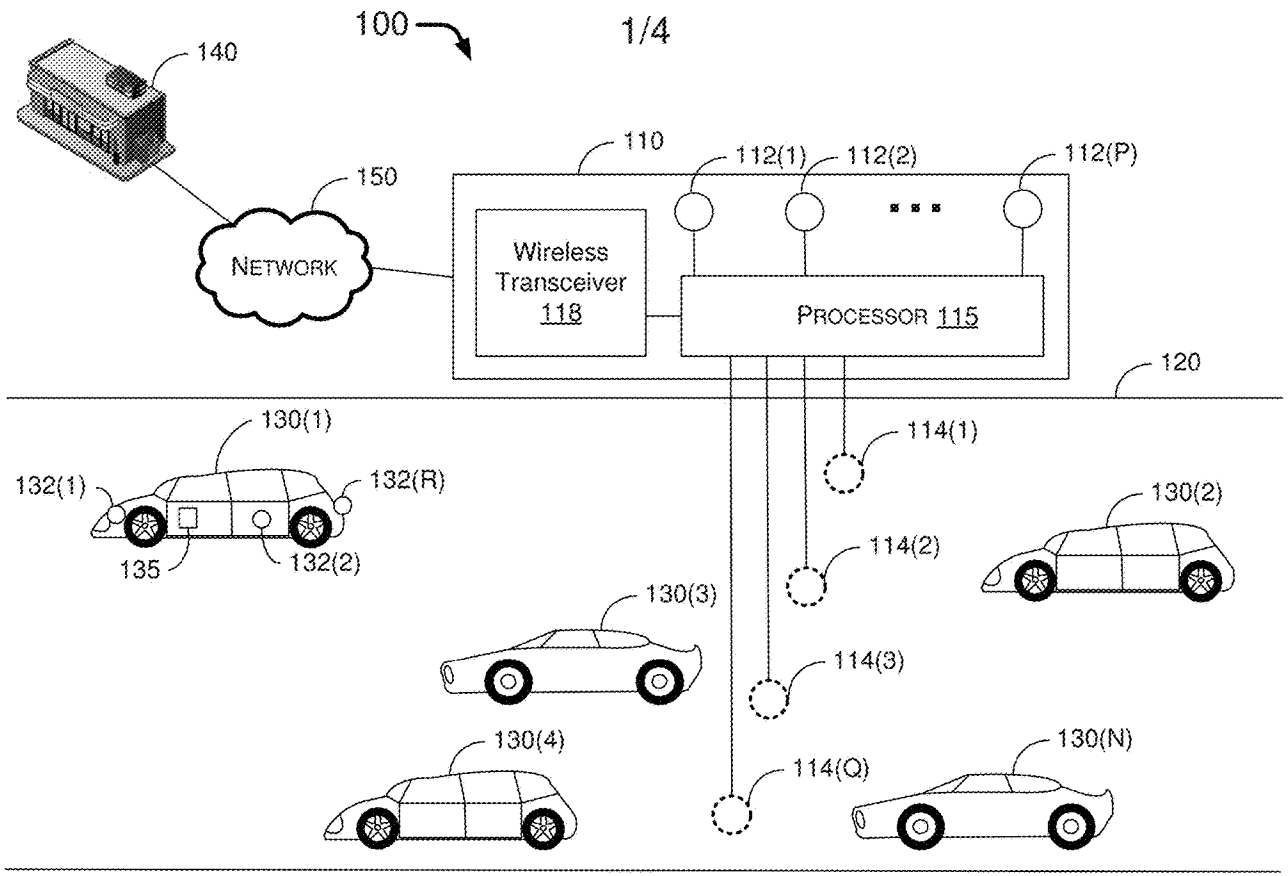
FIG. 1 is a diagram depicting an example scenario in which embodiments in accordance with the present disclosure may be utilized.

FIG. 1 illustrates an example scenario 100 in which embodiments in accordance with the present disclosure may be utilized. To avoid or otherwise ameliorate the aforementioned problem with sensor malfunction, the present disclosure proposes techniques, schemes, processes and apparatus pertaining to vehicle sensor health monitoring. Under a proposed scheme, as shown in scenario 100, a road-side station 110 may be provided near or alongside a road 120 to communication with a number of autonomous vehicles 130(1)-130(N) (e.g., via a vehicle-to-everything (V2X) communication protocol). The road-side station 110 may be equipped with a processor 115 which controls at least operations of the road-side station 110 with respect to various embodiments in accordance with the present disclosure. The road-side station 110 may also be equipped with one or more scanning sensors 112(1)-112(P) (hereinafter interchangeably referred as "scanning sensor(s)") and/or one or more sensors 114(1)-114(Q) embedded in the road (hereinafter interchangeably referred as "embedded sensor(s)"). The scanning sensor(s) 112(1)-112(P) and/or the embedded sensor(s) 114(1)-114(Q) can provide ground truth positioning of autonomous vehicles 130(1)-130(N) traveling on road 120. Each of the parameters N, P and Q is a positive integer greater or equal to 1. The road-side station 110 may further be equipped with a wireless transceiver 118 capable of establishing wireless communications with autonomous vehicles 130(1)-130(N). It is noteworthy that, in FIG. 1, road-side station 110 and autonomous vehicles 130(1)-130(N) are not drawn to scale.

In some embodiments, the scanning sensor(s) 112(1)-112(P) and the embedded sensor(s) 114(1)-114(Q) may be capable of sensing or otherwise detecting data related to vehicle positioning, weather monitoring, precipitation monitoring, anomaly detection, malevolent intention detection, or a combination thereof. Correspondingly, each of the scanning sensor(s) 112(1)-112(P) and the embedded sensor(s) 114(1)-114(Q) may provide respective sensor data (hereinafter collectively referred as "station sensor data") related to a result of vehicle positioning, weather monitoring, precipitation monitoring, anomaly detection, malevolent intention detection, or a combination thereof. The station sensor data may also include object classification data regarding the classification of moving and non-moving objects on or near the road such as, for example and without limitation, vehicles, motorcycles, bicycles, pedestrians, obstructions and infrastructure.

With respect to vehicle positioning, the scanning sensor(s) 112(1)-112(P) and/or the embedded sensor(s) 114(1)-114(Q) may include, for example and without limitation, one or more Light Detection and Ranging (LIDAR) detectors, one or more Radio Detection and Ranging (RADAR) detectors, one or more infrared cameras, one or more visible light cameras, and/or one or more road pressure sensors. With respect to weather and precipitation monitoring, the scanning sensor(s) 112(1)-112(P) and/or the embedded sensor(s) 114(1)-114(Q) may include, for example and without limitation, one or more barometric pressure sensors, one or more precipitation sensors, one or more ground condition sensors, one or more temperature sensors, one or more wind speed sensors, and/or one or more wind direction sensors. With respect to anomaly and malevolent intention detection, the scanning sensor(s) 112(1)-112(P) and/or the embedded sensor(s) 114(1)-114(Q) may include, for example and without limitation, one or more spectrum sensing systems which may operate at automotive RADAR frequencies (e.g., 76~81 GHz).

With respect to vehicle positioning, the station sensor data from the scanning sensor(s) 112(1)-112(P) and/or the embedded sensor(s) 114(1)-114(Q) may be compiled, accumulated, calculated or otherwise computed by road-side station 110 to determine the size, position and/or speed of each of one or more of vehicles 130(1)-130(N). The sensor data may also be used by the road-side station 110 to detect animals, pedestrians and debris, and may be collected for purposes including traffic statistics. For example, one or more LIDAR detectors may be used to provide a reliable base for determining the size and position of a vehicle. As another example, one or more RADAR detectors may be used to verify the position of a vehicle as determined by a LIDAR detector, and may also be used to determine the speed of the vehicle (e.g., through Doppler shift of incoming/reflected RADAR signals). As another example, one or more infrared cameras may be used to detect heat signatures of the engine, brakes and/or tires of a vehicle to possibly provide better data for vehicle positioning and classification in poor weather conditions or in the dark, as compared to a visible light camera. The infrared camera(s) may also detect anomalies such as, for example, a deer or a pedestrian on or near road 120, which may be difficult to see from the vantage point of a vehicle. As another example, one or more visible light cameras may be used to provide images to be analyzed by road-side station 110 to further classify a vehicle which may be detected by any of the other types of sensors. As a further example, one or more road pressure sensors may be used after computations on sensor data from other type(s) of sensor(s) are performed to provide a final ground truth data or reference. When a prediction of a position of a vehicle correlates well with the road pressure sensor data, the prediction may be considered accurate. However, when the prediction does not correlate well with the road pressure sensor data, a recalculation of the prediction may be performed using the new ground truth data as a starting point.

With respect to weather and precipitation monitoring, the station sensor data from the scanning sensor(s) 112(1)-112(P) and/or the embedded sensor(s) 114(1)-114(Q) may be compiled, accumulated, calculated or otherwise computed by road-side station 110 to determine or otherwise predict local weather and/or precipitation status. For example, one or more barometric pressure sensors may be used to determine or otherwise predict localized weather (e.g., in conjunction with information retrieved from one or more online sources over the Internet). As another example, one or more precipitation sensors may be used to determine the state of precipitation (e.g., clear, rain, sleet, snow, fog and the like). Such information may be reported out by the road-side station 110 (e.g., by broadcasting) to autonomous vehicles 130(1)-130(N) so that each of autonomous vehicles 130(1)-130(N) can check the function of its respective precipitation sensor(s) and determine whether auxiliary sensor(s) may need to be used. Moreover, in heavy precipitation, LIDAR detectors may not perform well due to reduced visibility. As another example, one or more ground condition sensors may be embedded in road 120 to determine whether road 120 is icy, wet, snowy, cold, dry or under any other condition. As another example, one or more temperature sensors may be used in conjunction with precipitation sensor(s) to determine whether present weather conditions may lead to snow or sleet. The road-side station 110 may communication such information to one or more of autonomous vehicles 130(1)-130(N) with traction control capability to ensure or otherwise remind such vehicle(s) to be in an appropriate traction control mode. As a further example, one or more wind speed and/or wind direction sensors may be used to monitor harsh wind speeds which may require corrective steering and/or increased or decreased vehicle power. The road-side station 110 may communication such information to autonomous vehicles 130(1)-130(N) to ensure that autonomous vehicles 130(1)-130(N) know that a certain amount of corrective measures may be needed. Otherwise, without such information, it may be possible that at least one of autonomous vehicles 130(1)-130(N) may determine something is wrong with itself.

With respect to anomaly detection and malevolent intention detection, the station sensor data from the scanning sensor(s) 112(1)-112(P) and/or the embedded sensor(s) 114(1)-114(Q) may be compiled, accumulated, calculated or otherwise computed by road-side station 110 to detect or otherwise determine anomalies and/or malevolent intentions or acts. For example, one or more spectrum sensing systems may be used to monitor the radio frequency spectrum at RADAR frequencies, thereby monitoring anomalies such as harmful noise generation. Excessive radio frequency (RF) noise generation in RADAR frequencies may render RADAR sensors useless, since RADAR sensors would not be able to read any data above the resulting noise floor. Upon detecting such anomalies and/or malevolent intentions/acts, the road-side station 110 may report to appropriate government agencies.

Each of autonomous vehicles 130(1)-130(N) may be equipped, installed or otherwise associated with a processor and one or more sensors. For illustrative purposes and without limitation, autonomous vehicle 130(1) is shown to have a processor 135 and one or more sensors 132(1)-132(R). To avoid obscuring the figure and for simplicity, processors and sensors are not shown on others of autonomous vehicles 130(1)-130(N). The one or more sensors on each of autonomous vehicles 130(1)-130(N) may be capable of sensing or otherwise detecting data related to vehicle positioning, weather monitoring, precipitation monitoring, anomaly detection, malevolent intention detection, or a combination thereof. Correspondingly, each of the one or more sensors of each of autonomous vehicles 130(1)-130(N) may provide respective sensor data (hereinafter collectively referred as "vehicle sensor data") related to a result of vehicle positioning, weather monitoring, precipitation monitoring, anomaly detection, malevolent intention detection, or a combination thereof.

With respect to vehicle positioning, the sensor(s) on each of autonomous vehicles 130(1)-130(N) may include, for example and without limitation, one or more Global Positioning System (GPS) sensors, one or more inertial measurement units (IMUs), one or more LIDAR detectors, one or more RADAR detectors, one or more infrared cameras, one or more visible light cameras, and/or one or more ultrasonic sensors. The vehicle sensor data from such sensor(s) may be used for functions such as global positioning, localization, object detection and object classification. For instance, the sensor data from GPS sensor(s), IMU(s), LIDAR detector(s) and camera(s) may be used for localization. Moreover, the sensor data from LIDAR detector(s), RADAR detector(s), camera(s) and ultrasonic sensor(s) may be used for object detection and object classification. With respect to weather and precipitation monitoring, the sensor(s) on each of autonomous vehicles 130(1)-130(N) may include, for example and without limitation, one or more precipitation sensors and/or one or more temperature sensors. With respect to anomaly and malevolent intention detection, the sensor(s) on each of autonomous vehicles 130(1)-130(N) may include, for example and without limitation, one or more powertrain sensors (e.g., wheel speed sensor(s) for monitoring wheel traction and speed). The sensor data from precipitation sensor(s), temperature sensor(s) and wheel speed sensor(s) may be used to determine weather and road conditions.

The road-side station 110 may operate in a number of modes, namely: a broadcast mode, an interactive mode, and a hybrid mode. In the broadcast mode, the road-side station 110 may broadcast station sensor data, collected by the scanning sensor(s) 112(1)-112(P) and/or the embedded sensor(s) 114(1)-114(Q) associated with the road-side station 110, to nearby autonomous vehicles such as autonomous vehicles 130(1)-130(N) traveling on road 120. Each of the autonomous vehicles 130(1)-130(N), upon receiving the station sensor data broadcasted by the road-side station 110, may perform one or more sanity checks using the station sensor data. For instance, an autonomous vehicle may use the station sensor data to determine whether there is inaccuracy or anomaly with respect to one or more local sensors associated with the autonomous vehicle. Additionally, the autonomous vehicle may use the station sensor data to determine whether there is inaccuracy or anomaly with respect to one or more algorithms and/or software programs utilized by, executed on or otherwise implemented in the autonomous vehicle. This allows the autonomous vehicle to determine the health (e.g., in terms of accuracy) with respect to each of its sensors.

In the interactive mode, the road-side station 110 may receive vehicle sensor data from one or more autonomous vehicles 130(1)-130(N) traveling on road 120, and may correlate or otherwise compare the received vehicle sensor data with ground truth data, represented by station sensor data collected by scanning sensor(s) 112(1)-112(P) and/or embedded sensor(s) 114(1)-114(Q) that are associated with the road-side station 110. The road-side station 110 may generate and transmit a health score to each of one or more of the autonomous vehicles 130(1)-130(N) from which respective vehicle sensor data has been received and compared to the ground truth data. The health score may indicate an overall state of health with respect to one or more sensors, one or more algorithms, and/or one or more software programs installed on, utilized by, or otherwise implemented in the autonomous vehicle. A high score may indicate proper functioning and/or no issue with accuracy of the one or more sensors, one or more algorithms, and/or one or more software programs. Conversely, a low score may indicate improper functioning and/or inaccuracy of the one or more sensors, one or more algorithms, and/or one or more software programs. Additionally or alternatively, the road-side station 110 may publish results of the comparison, via a network 150, to one or more remote locations (shown as remote station 140 in FIG. 1) such as, for example and without limitation, one or more automobile service center, one or more automobile dealer networks, and/or one or more vehicle manufacturers. In some embodiments, the interactive mode may be utilized by regulatory services and/or government agencies that require accurate information about vehicle sensor health and object classification accuracy.

In the hybrid mode, the road-side station 110 may function as in the broadcast mode and also require each of one or more of the autonomous vehicles 130(1)-130(N) receiving the broadcast to return a respective health report. Although the hybrid mode may be less resilient to potentially inaccurate vehicle health reports (e.g., due to hacking or malfunctioning software), the hybrid mode permits the road-side station 110 to communicate to remote location 140 (e.g., an automobile service center, an automobile dealer network or a vehicle manufacturer) regarding the need of service or repair for one or more sensors of a given autonomous vehicle.

Figure 2:
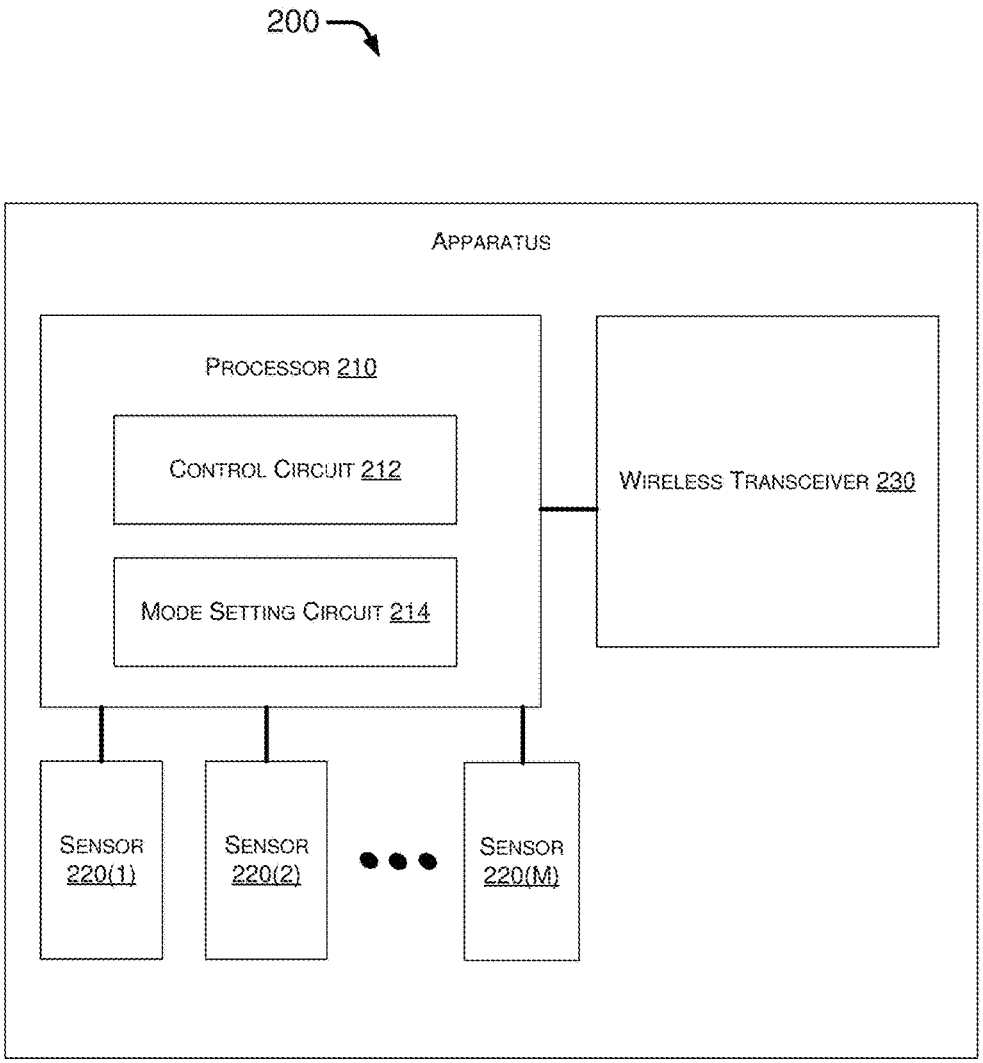
FIG. 2 is a block diagram depicting an example apparatus in accordance with an embodiment of the present disclosure.

FIG. 2 illustrates an example apparatus 200 in accordance with an embodiment of the present disclosure. Apparatus 200 may perform various functions related to techniques, schemes, methods and systems described herein pertaining to vehicle sensor health monitoring, including those described above with respect to scenario 100 as well as those described below with respect to process 300 and process 400. Apparatus 200 may be implemented as or in road-side station 110 in scenario 100 to effect various embodiments in accordance with the present disclosure. That is, in some embodiments, apparatus 200 may be an example implementation of road-side station 110. Apparatus 200 may include one, some or all of the components shown in FIG. 2. Apparatus 200 may also include one or more other components not be pertinent to various embodiments of the present disclosure and, thus, such component(s) is/are not shown in FIG. 2 and a description thereof is not provided herein in the interest of brevity.

Apparatus 200 may include at least a processor 210, which may include a control circuit 212 and a mode setting circuit 214. Processor 210 may be implemented in the form of one or more single-core processors, one or more multi-core processors, or one or more CISC processors. Thus, even though a singular term "a processor" is used herein to refer to processor 210, processor 210 may include multiple processors in some embodiments and a single processor in other embodiments in accordance with the present disclosure. In another aspect, processor 210 may be implemented in the form of hardware (and, optionally, firmware) with electronic components including, for example and without limitation, one or more transistors, one or more diodes, one or more capacitors, one or more resistors and/or one or more inductors that are configured and arranged to achieve specific purposes in accordance with the present disclosure. In other words, in at least some embodiments, processor 210 is a special-purpose machine specifically designed, arranged and configured to perform specific tasks including vehicle sensor health monitoring in accordance with various embodiments of the present disclosure. Processor 210 may be an example implementation of processor 115 of road-side station 110.

Apparatus 200 may also include one or more sensors 220(1)-220(M) capable of collecting station sensor data described above with respect to road-side station 110. The one or more sensors 220(1)-220(M) may be example implementations of the scanning sensor(s) 112(1)-112(P) and/or the embedded sensor(s) 114(1)-114(Q) described above. In some embodiments, the one or more sensors 220(1)-220(M) may include a LIDAR detector, a RADAR detector, an infrared camera, a visible light camera, a road pressure sensor, a barometric pressure sensor, a precipitation sensor, a ground condition sensor, a temperature sensor, a wind speed sensor, a wind direction sensor, a spectrum sensing device, or a combination thereof. In some embodiments, the station sensor data may include data related to vehicle positioning, weather monitoring, precipitation monitoring, anomaly detection, malevolent intention detection, or a combination thereof, collected by the one or more sensors. Accordingly, capabilities, features and description of the scanning sensor(s) 112(1)-112(P) and the embedded sensor(s) 114(1)-114(Q) are applicable to the one or more sensors 220(1)-220(M) and, thus, will not be repeated to avoid redundancy.

Apparatus 200 may further include a wireless transceiver 230 capable of establishing wireless communications with one or more vehicles such as autonomous vehicles 130(1)-130(N), for example. In some embodiments, the wireless transceiver 230 may be capable of establishing the wireless communications with the one or more vehicles via a vehicle-to-everything (V2X) communication technology or any applicable wireless technology.

Processor 210 may be communicatively coupled to the one or more sensors 220(1)-220(M) and the wireless transceiver 230. Control circuit 212 may be capable of receiving the station sensor data from the one or more sensors 220(1)-220(M). Control circuit 212 may be also capable of communicating with the one or more vehicles through the wireless transceiver 230. Control circuit 212 may be further capable of generating a health score or health report indicating a condition associated with at least one vehicle of the one or more vehicles.

In some embodiments, control circuit 212 may be capable of transmitting the health score via the wireless transceiver 230 to the at least one vehicle, a remote location (e.g., remote location 140), or both.

In some embodiments, control circuit 212 may be capable of operating in an interactive mode with respect to the one or more vehicles by performing a number of operations. For instance, control circuit 212 may be capable of receiving vehicle sensor data from the at least one vehicle of the one or more vehicles via the wireless transceiver 230. Additionally, control circuit 212 may be capable of comparing the vehicle sensor data and the station sensor data. Moreover, control circuit 212 may be capable of generating the health score responsive to a result of the comparing indicating a difference between the vehicle sensor data and the station sensor data. Furthermore, control circuit 212 may be capable of transmitting, via the wireless transceiver 230, the health score to the at least one vehicle, a remote location (e.g., remote location 140), or both. In some embodiments, the vehicle sensor data may include data related to vehicle positioning, weather monitoring, precipitation monitoring, anomaly detection, malevolent intention detection, or a combination thereof, collected by one or more sensors associated with the at least one vehicle.

In some embodiments, control circuit 212 may be capable of operating in a broadcast mode with respect to the one or more vehicles by broadcasting, via the wireless transceiver 230, the station sensor data to the one or more vehicles.

In some embodiments, control circuit 212 may be capable of operating in a hybrid mode with respect to the one or more vehicles by performing a number of operations. For instance, control circuit 212 may be capable of broadcasting, via the wireless transceiver 230, the station sensor data to the one or more vehicles. Moreover, control circuit 212 may be capable of receiving, via the wireless transceiver 230, a health report from the at least one vehicle of the one or more vehicles responsive to the broadcasting. The health report may indicate inaccuracy or anomaly with respect to one or more sensors associated with the at least one vehicle, one or more algorithms implemented by the at least one vehicle, or a combination thereof.

In some embodiments, in broadcasting the station sensor data to the one or more vehicles, control circuit 212 may be capable of broadcasting, via the wireless transceiver 230, the station sensor data to the one or more vehicles with a request that triggers that at least one vehicle to provide the health report.

Mode setting circuit 214 may be capable of selecting an operational mode, from a number of modes, in which processor 210 may operate. In some embodiments, the number of modes available for the mode setting circuit 214 to select may include the broadcast mode, the interactive mode and the hybrid mode as described above with respect to scenario 100. Accordingly, a detailed description of each of the broadcast mode, interactive mode and hybrid mode is not repeated to avoid redundancy. In some embodiments, mode setting circuit 214 may receive, via wireless transceiver 230, a user command that instructs the mode setting circuit 214 to select one of the modes for processor 210 to operate in the selected mode.

Figure 3:
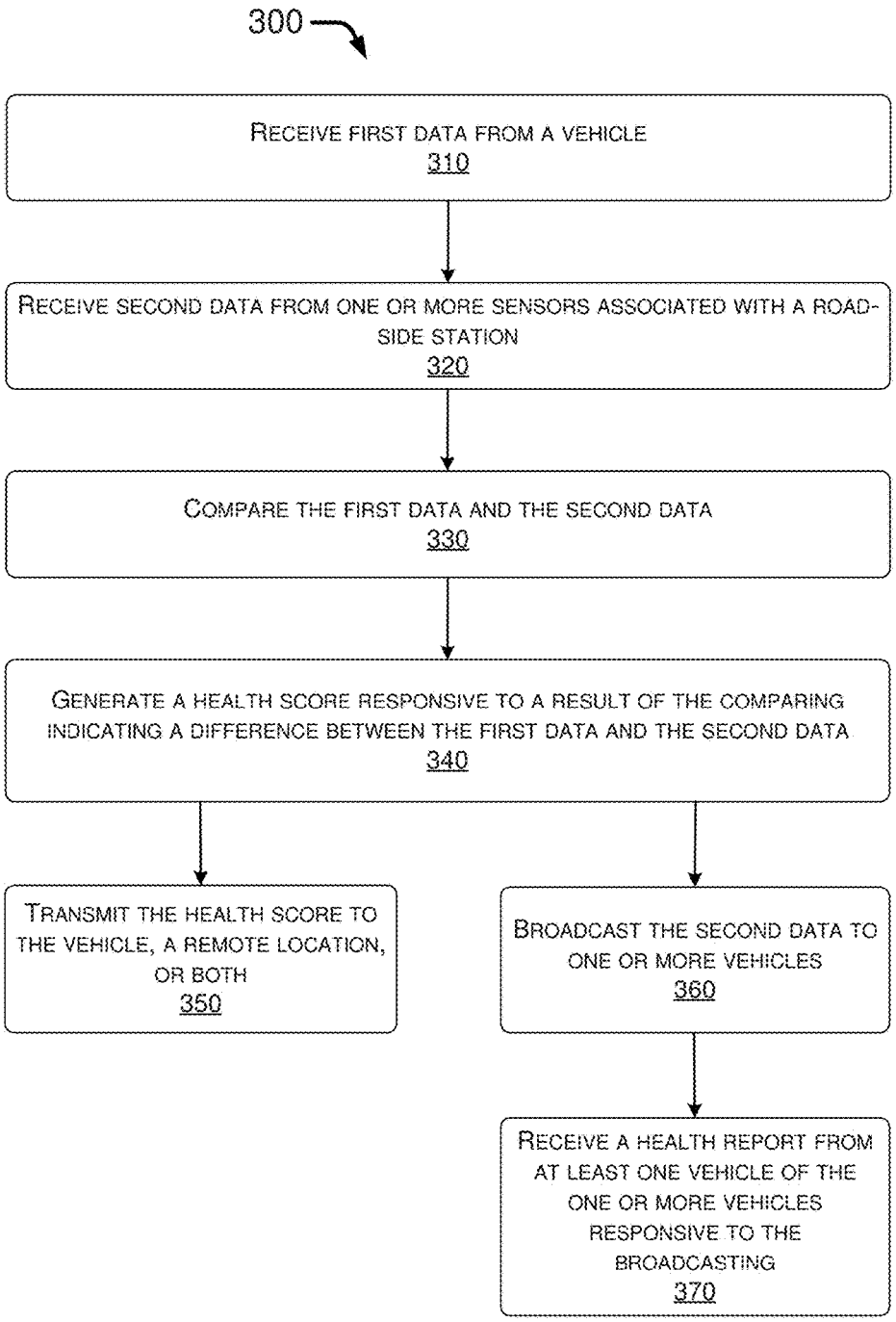
FIG. 3 is a flowchart depicting an example process in accordance with an embodiment of the present disclosure.

FIG. 3 illustrates an example process 300 in accordance with an embodiment of the present disclosure. Process 300 may include one or more operations, actions, or functions shown as blocks such as 310, 320, 330, 340, 350, 360 and 370. Although illustrated as discrete blocks, various blocks of process 300 may be divided into additional blocks, combined into fewer blocks, or eliminated, depending on the desired implementation. Process 300 may be implemented in scenario 100 and/or by apparatus 200. For illustrative purposes and without limitation, the following description of process 300 is provided in the context of road-side station 110 in scenario 100. Process 300 may begin with block 310.

At 310, process 300 may involve processor 115 of road-side station 110 receiving first data (e.g., vehicle sensor data) from a vehicle (e.g., autonomous vehicle 130(1)). Process 300 may proceed from 310 to 320.

At 320, process 300 may involve processor 115 receiving second data (e.g., station sensor data) from one or more sensors (e.g., scanning sensor(s) 112(1)-112(P) and/or embedded sensor(s) 114(1)-114(Q)) associated with road-side station 110. Process 300 may proceed from 320 to 330.

At 330, process 300 may involve processor 115 comparing the first data and the second data. Process 30 may proceed from 330 to 340.

At 340, process 300 may involve processor 115 generating a health score responsive to a result of the comparing indicating a difference between the first data and the second data. Process 300 may proceed from 340 to either 350 or 360.

At 350, process 300 may involve processor 115 transmitting the health score to the vehicle, a remote location (e.g., remote location 140), or both, responsive to the result of the comparing indicating the difference between the first data and the second data.

At 360, process 300 may involve processor 115 broadcasting the second data to one or more vehicles. Process 300 may proceed from 360 to 370.

At 370, process 300 may involve processor 115 receiving a health report from at least one vehicle of the one or more vehicles responsive to the broadcasting.

In some embodiments, the first data may include data related to vehicle positioning, weather monitoring, precipitation monitoring, anomaly detection, malevolent intention detection, or a combination thereof, collected by one or more sensors associated with the vehicle.

In some embodiments, the second data may include data related to vehicle positioning, weather monitoring, precipitation monitoring, anomaly detection, malevolent intention detection, or a combination thereof, collected by the one or more sensors associated with the road-side station.

Figure 4:
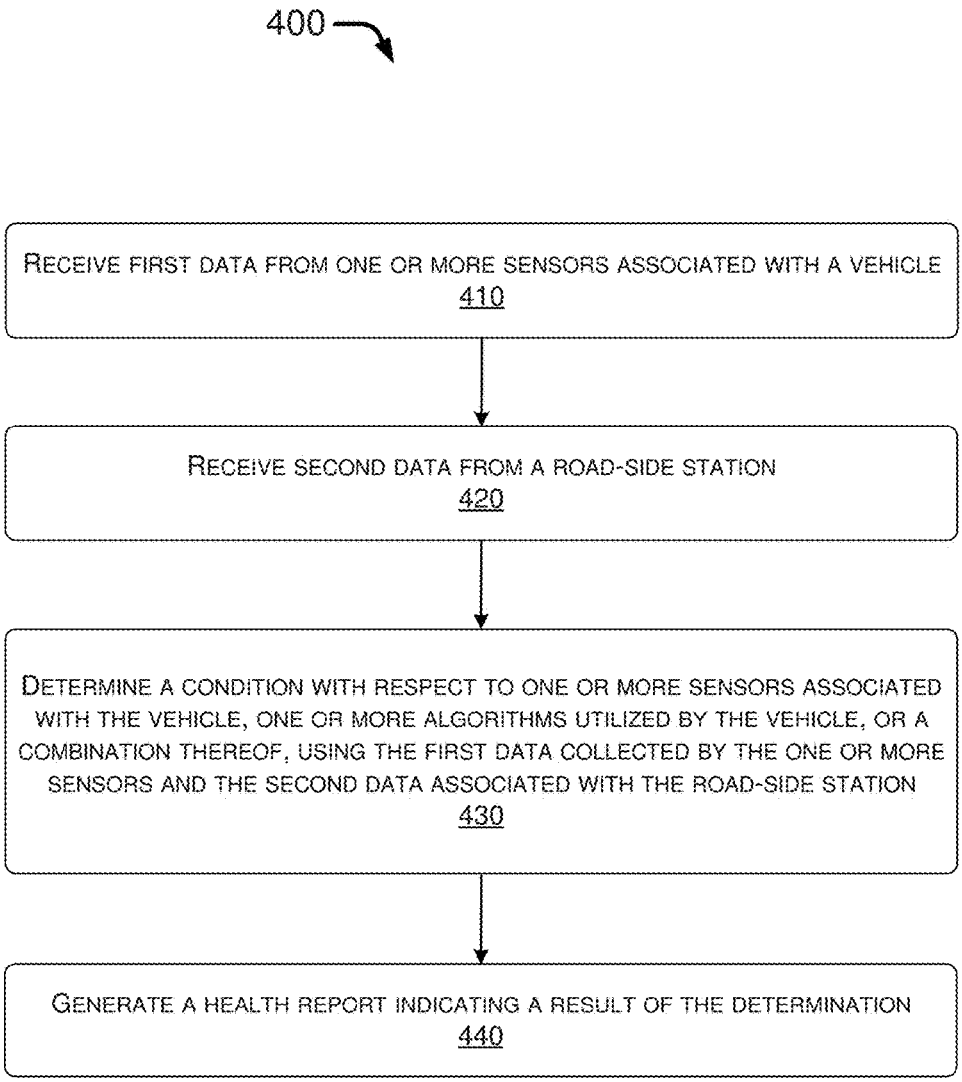
FIG. 4 is a flowchart depicting an example process in accordance with an embodiment of the present disclosure.

FIG. 4 illustrates an example process 400 in accordance with an embodiment of the present disclosure. Process 400 may include one or more operations, actions, or functions shown as blocks such as 410, 420, 430 and 440. Although illustrated as discrete blocks, various blocks of process 400 may be divided into additional blocks, combined into fewer blocks, or eliminated, depending on the desired implementation. Process 400 may be implemented in scenario 100 and/or by autonomous vehicles 130(1)-130(N). For illustrative purposes and without limitation, the following description of process 400 is provided in the context of vehicle 130(1) in scenario 100. Process 400 may begin with block 410.

At 410, process 400 may involve processor 135 of vehicle 130(1) receiving first data (e.g., vehicle sensor data) from one or more sensors (e.g., the one or more sensors 132(1)-132(R)) associated with vehicle 130(1). Process 400 may proceed from 410 to 420.

At 420, process 400 may involve processor 135 receiving second data (e.g., station sensor data) from a road-side station (e.g., road-side station 110). Process 400 may proceed from 420 to 430.

At 430, process 400 may involve processor 135 of vehicle 130(1) determining a condition with respect to one or more sensors (e.g., the one or more sensors 132(1)-132(R)) associated with vehicle 130(1), one or more algorithms utilized by vehicle 130(1), or a combination thereof, using the first data (e.g., vehicle sensor data) collected by the one or more sensors and the second data (e.g., station sensor data) associated with the road-side station (e.g., road-side station 110). Process 400 may proceed from 430 to 440.

At 440, process 400 may involve processor 135 generating a health report indicating a result of the determining. The health report may indicate inaccuracy or anomaly with respect to the one or more sensors associated with vehicle 130(1), the one or more algorithms utilized by vehicle 130(1), or a combination thereof.

In some embodiments, the first data may include data related to vehicle positioning, weather monitoring, precipitation monitoring, anomaly detection, malevolent intention detection, or a combination thereof.

In some embodiments, the second data may include data related to vehicle positioning, weather monitoring, precipitation monitoring, anomaly detection, malevolent intention detection, or a combination thereof.

In the above disclosure, reference has been made to the accompanying drawings, which form a part hereof, and in which is shown by way of illustration specific implementations in which the present disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Implementations of the systems, apparatuses, devices, and methods disclosed herein may comprise or utilize a special purpose or general-purpose computer including computer hardware, such as, for example, one or more processors and system memory, as discussed herein. Implementations within the scope of the present disclosure may also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media (devices). Computer-readable media that carry computer-executable instructions are transmission media. Thus, by way of example, and not limitation, implementations of the present disclosure can comprise at least two distinctly different kinds of computer-readable media: computer storage media (devices) and transmission media.

Computer storage media (devices) includes RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general purpose or special purpose computer.

An implementation of the devices, systems, and methods disclosed herein may communicate over a computer network. A "network" is defined as one or more data links that enable the transport of electronic data between computer systems and/or modules and/or other electronic devices. When information is transferred or provided over a network or another communications connection (either hardwired, wireless, or any combination of hardwired or wireless) to a computer, the computer properly views the connection as a transmission medium. Transmissions media can include a network and/or data links, which can be used to carry desired program code means in the form of computer-executable instructions or data structures and which can be accessed by a general purpose or special purpose computer. Combinations of the above should also be included within the scope of computer-readable media.

Computer-executable instructions comprise, for example, instructions and data which, when executed at a processor, cause a general purpose computer, special purpose computer, or special purpose processing device to perform a certain function or group of functions. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the present disclosure may be practiced in network computing environments with many types of computer system configurations, including, an in-dash vehicle computer, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, various storage devices, and the like. The disclosure may also be practiced in distributed system environments where local and remote computer systems, which are linked (either by hardwired data links, wireless data links, or by any combination of hardwired and wireless data links) through a network, both perform tasks. In a distributed system environment, program modules may be located in both local and remote memory storage devices.

Further, where appropriate, functions described herein can be performed in one or more of: hardware, software, firmware, digital components, or analog components. For example, one or more application specific integrated circuits (ASICs) can be programmed to carry out one or more of the systems and procedures described herein. Certain terms are used throughout the description and claims to refer to particular system components. As one skilled in the art will appreciate, components may be referred to by different names. This document does not intend to distinguish between components that differ in name, but not function.

It should be noted that the sensor embodiments discussed above may comprise computer hardware, software, firmware, or any combination thereof to perform at least a portion of their functions. For example, a sensor may include computer code configured to be executed in one or more processors, and may include hardware logic/electrical circuitry controlled by the computer code. These example devices are provided herein purposes of illustration, and are not intended to be limiting. Embodiments of the present disclosure may be implemented in further types of devices, as would be known to persons skilled in the relevant art(s).

At least some embodiments of the present disclosure have been directed to computer program products comprising such logic (e.g., in the form of software) stored on any computer useable medium. Such software, when executed in one or more data processing devices, causes a device to operate as described herein.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described exemplary embodiments, but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure.

The invention claimed is:

1. A method, comprising:

receiving, by a processor of a road-side station, first data from a vehicle;

receiving, by the processor, second data from one or more sensors associated with the road-side station at least one of which embedded in a road on which the vehicle travels, with the second data indicating at least ground truth positioning of the vehicle;

comparing, by the processor, the first data and the second data; and generating, by the processor, a health score responsive to a result of the comparing indicating a difference between the first data and the second data.

2. The method of claim 1, wherein the first data comprises data related to vehicle positioning, weather monitoring, precipitation monitoring, anomaly detection, malevolent intention detection, or a combination thereof, collected by one or more sensors associated with the vehicle.

3. The method of claim 1, wherein the second data comprises data related to vehicle positioning, weather monitoring, precipitation monitoring, anomaly detection, malevolent intention detection, or a combination thereof, collected by the one or more sensors associated with the road-side station.

4. The method of claim 1, further comprising:

transmitting the health score to the vehicle, a remote location, or both.

5. The method of claim 1, further comprising:

broadcasting the second data to one or more vehicles.

6. The method of claim 5, further comprising:

receiving a health report from at least one vehicle of the one or more vehicles responsive to the broadcasting.

7. A method, comprising:

determining, by a processor associated with a vehicle, a condition with respect to one or more sensors associated with the vehicle, one or more algorithms utilized by the vehicle, or a combination thereof, using first data collected by the one or more sensors and second data associated with a road-side station, with the second data collected by one or more sensors embedded in a road on which the vehicle travels and indicating at least ground truth positioning of the vehicle; and generating, by the processor, a health report indicating a result of the determining, the health report indicating inaccuracy or anomaly with respect to the one or more sensors associated with the vehicle, the one or more algorithms utilized by the vehicle, or a combination thereof.

8. The method of claim 7, wherein the first data comprises data related to vehicle positioning, weather monitoring, precipitation monitoring, anomaly detection, malevolent intention detection, or a combination thereof.

9. The method of claim 7, wherein the second data comprises data related to vehicle positioning, weather monitoring, precipitation monitoring, anomaly detection, malevolent intention detection, or a combination thereof.

10. The method of claim 7, further comprising:

receiving the first data from the one or more sensors; and receiving the second data from the road-side station.

11. An apparatus, comprising:

one or more sensors capable of collecting station sensor data;

a wireless transceiver capable of establishing wireless communications with one or more vehicles; and a processor communicatively coupled to the one or more sensors and the wireless transceiver, the processor capable of receiving the station sensor data from the one or more sensors, the processor also capable of communicating with the one or more vehicles through the wireless transceiver, the processor further capable of generating a health score indicating a condition associated with at least one vehicle of the one or more vehicles, wherein at least one of the one or more sensors is embedded in a road on which the vehicle travels and capable of generating data indicating ground truth positioning of the vehicle.

12. The apparatus of claim 11, wherein the station sensor data comprises data related to vehicle positioning, weather monitoring, precipitation monitoring, anomaly detection, malevolent intention detection, or a combination thereof, collected by the one or more sensors.

13. The apparatus of claim 11, wherein the one or more sensors comprise a light detection and ranging (LiDAR) sensor, a radio detection and ranging (RADAR) sensor, an infrared camera, a visible light camera, a road pressure sensor, a barometric pressure sensor, a precipitation sensor, a ground condition sensor, a temperature sensor, a wind speed sensor, a wind direction sensor, a spectrum sensing device, or a combination thereof.

14. The apparatus of claim 11, wherein the wireless transceiver is capable of establishing the wireless communications with the one or more vehicles via a vehicle-to-everything (V2X) communication technology.

15. The apparatus of claim 11, wherein the processor is further capable of transmitting the health score via the wireless transceiver to the at least one vehicle, a remote location, or both.

16. The apparatus of claim 11, wherein the processor is capable of operating in an interactive mode with respect to the one or more vehicles by performing operations comprising:

receiving vehicle sensor data from the at least one vehicle of the one or more vehicles;

comparing the vehicle sensor data and the station sensor data;

generating the health score responsive to a result of the comparing indicating a difference between the vehicle sensor data and the station sensor data; and transmitting, via the wireless transceiver, the health score to the at least one vehicle, a remote location, or both.

17. The apparatus of claim 16, wherein the vehicle sensor data comprises data related to vehicle positioning, weather monitoring, precipitation monitoring, anomaly detection, malevolent intention detection, or a combination thereof, collected by one or more sensors associated with the at least one vehicle.

18. The apparatus of claim 11, wherein the processor is capable of operating in a broadcast mode with respect to the one or more vehicles by performing operations comprising:

broadcasting the station sensor data to the one or more vehicles.

19. The apparatus of claim 11, wherein the processor is capable of operating in a hybrid mode with respect to the one or more vehicles by performing operations comprising:

broadcasting the station sensor data to the one or more vehicles; and receiving a health report from the at least one vehicle of the one or more vehicles responsive to the broadcasting, the health report indicating inaccuracy or anomaly with respect to one or more sensors associated with the at least one vehicle, one or more algorithms implemented by the at least one vehicle, or a combination thereof.

20. The apparatus of claim 19, wherein, in broadcasting the station sensor data to the one or more vehicles, the processor is capable of broadcasting the station sensor data to the one or more vehicles with a request that triggers the at least one vehicle to provide the health report.

* * * * *